US010344422B2

(12) United States Patent
Kwon et al.

(10) Patent No.: US 10,344,422 B2
(45) **Date of Patent: *Jul. 9, 2019**

(54) LAUNDRY TREATING APPARATUS

(71) Applicant: LG ELECTRONICS INC., Seoul (KR)

(72) Inventors: Yongwoo Kwon, Seoul (KR); Seungji Yong, Seoul (KR); Kangwoon Cheon, Seoul (KR); Jaehoon Choi, Seoul (KR); Jungjin Park, Seoul (KR)

(73) Assignee: LG ELECTRONICS INC., Seoul (KR)

( * ) Notice: Subject to any disclaimer, the term of this patent is extended or adjusted under 35 U.S.C. 154(b) by 93 days.

This patent is subject to a terminal disclaimer.

(21) Appl. No.: 15/339,055

(22) Filed: Oct. 31, 2016

(65) Prior Publication Data

US 2017/0121897 A1 May 4, 2017

Related U.S. Application Data

(60) Provisional application No. 62/249,355, filed on Nov. 2, 2015.

(30) Foreign Application Priority Data

Jan. 5, 2016 (KR) ..... 10-2016-0001184
Apr. 1, 2016 (KR) ..... 10-2016-0040456

(51) Int. Cl.
*D06F 39/14* (2006.01)
*D06F 39/00* (2006.01)
(Continued)

(52) U.S. Cl.
CPC ..... *D06F 39/14* (2013.01); *D06F 37/304* (2013.01); *D06F 39/005* (2013.01); *D06F 39/02* (2013.01);
(Continued)

(58) Field of Classification Search
CPC ..... Y10T 16/558; Y10T 16/5595; Y10T 16/55963; D06F 37/10; D06F 37/28;
(Continued)

(56) References Cited

U.S. PATENT DOCUMENTS 3,042,471 A 7/1962 Haslup
5,358,773 A 10/1994 Fujii et al.
(Continued)

FOREIGN PATENT DOCUMENTS

CN 1936157 3/2007
CN 2898087 5/2007
(Continued)

OTHER PUBLICATIONS

KR20020048576A Translated Description, 5 pages (Year: 2002).*
(Continued)

*Primary Examiner* — Andrew M Roersma
(74) *Attorney, Agent, or Firm* — Ked & Associates, LLP

(57) ABSTRACT

A laundry treating apparatus includes: a body having a laundry introduction opening of a circular shape; a door configured to open or close the laundry introduction opening and having a display and a circular shape eccentric from the laundry introduction opening; and a hinge having a mounting portion mounted to the body, and configured to rotatably connect the door to the body, wherein a width of a lower end region of the mounting portion is narrower than a width of an upper end region of the mounting portion.

13 Claims, 16 Drawing Sheets

(51) Int. Cl.

| | |
|---|---|
| ***D06F 37/30*** | (2006.01) |
| ***D06F 39/02*** | (2006.01) |
| ***D06F 58/20*** | (2006.01) |
| ***D06F 37/28*** | (2006.01) |
| ***D06F 58/08*** | (2006.01) |

(52) U.S. Cl.
CPC ..... *D06F 58/20* (2013.01); *D06F 37/28* (2013.01); *D06F 58/08* (2013.01)

(58) Field of Classification Search
CPC ..... D06F 39/14; D06F 49/003; D06F 58/04; D06F 58/20
See application file for complete search history.

(56) References Cited

U.S. PATENT DOCUMENTS

| | | | | |
|---|---|---|---|---|
| 8,151,603 | B2 | 4/2012 | Kang et al. | |
| 9,268,068 | B2 | 2/2016 | Lee | |
| 9,708,749 | B2 | 7/2017 | Woo et al. | |
| 9,810,590 | B2 | 11/2017 | Huppi et al. | |
| 10,006,159 | B2 | 6/2018 | Kwon et al. | |
| 2005/0073628 | A1 | 4/2005 | Morsch | |
| 2006/0059710 | A1* | 3/2006 | Kim | D06F 39/14 34/603 |
| 2006/0117813 | A1 | 6/2006 | Ha et al. | |
| 2006/0218975 | A1* | 10/2006 | Graute | D06F 37/28 68/3 R |
| 2008/0273016 | A1 | 11/2008 | Helgesen | |
| 2009/0064534 | A1 | 3/2009 | Leclerc | |
| 2009/0121970 | A1* | 5/2009 | Ozbek | D06F 37/28 345/4 |
| 2010/0187023 | A1 | 7/2010 | Min | |
| 2010/0245271 | A1 | 9/2010 | Park | |
| 2011/0296628 | A1* | 12/2011 | Jenkins | D06F 35/00 8/137 |
| 2012/0036900 | A1 | 2/2012 | Hong et al. | |
| 2012/0049703 | A1 | 3/2012 | Fang et al. | |
| 2013/0076220 | A1 | 3/2013 | Yeom et al. | |
| 2013/0234573 | A1 | 9/2013 | Coxon | |
| 2014/0016290 | A1 | 1/2014 | Lee et al. | |
| 2014/0063367 | A1 | 3/2014 | Yang et al. | |
| 2014/0157673 | A1* | 6/2014 | Bazzinotti | D06F 31/00 49/70 |
| 2015/0008807 | A1 | 1/2015 | Kim et al. | |
| 2015/0123525 | A1 | 5/2015 | Woo et al. | |
| 2017/0121886 | A1* | 5/2017 | Kwon | D06F 37/28 |
| 2017/0121898 | A1* | 5/2017 | Kwon | D06F 39/14 |

FOREIGN PATENT DOCUMENTS

| | | | | |
|---|---|---|---|---|
| CN | 101096810 A * | 1/2008 | | D06F 37/28 |
| CN | 201103058 | 8/2008 | | |
| CN | 101333755 | 12/2008 | | |
| CN | 101805979 | 8/2010 | | |
| CN | 101818439 | 9/2010 | | |
| CN | 102191633 | 9/2011 | | |
| CN | 102317534 | 1/2012 | | |
| CN | 202116878 | 1/2012 | | |
| CN | 102560960 | 7/2012 | | |
| CN | 102733135 | 10/2012 | | |
| CN | 204298638 | 4/2015 | | |
| CN | 104674521 | 6/2015 | | |
| DE | 2 261 275 | 5/1974 | | |
| DE | 202 10 707 | 11/2003 | | |
| DE | 10-2005-024934 | 12/2006 | | |
| DE | 102005058898 | 12/2006 | | |
| DE | 20 2009 005 678 | 6/2009 | | |
| DE | 10 2009 007 920 | 4/2010 | | |
| DE | 10 2013 001 682 | 9/2013 | | |
| DE | 10 2013 208 851 | 11/2014 | | |
| EP | 1595992 A1 * | 11/2005 | | D06F 37/28 |
| EP | 2 077 349 | 7/2009 | | |
| EP | 2 161 364 | 3/2010 | | |
| EP | 2 581 485 | 4/2013 | | |
| EP | 2 742 843 | 6/2014 | | |
| EP | 2 837 728 | 2/2015 | | |
| EP | 2 843 105 | 3/2015 | | |
| EP | 2 868 795 | 5/2015 | | |
| EP | 3040467 | 7/2016 | | |
| GB | 2070130 A * | 9/1981 | | D06F 39/14 |
| GB | 2 118 580 | 11/1983 | | |
| JP | H 08-84891 | 4/1996 | | |
| JP | 2006-229319 | 8/2006 | | |
| JP | 2011-234785 | 11/2011 | | |
| JP | 2013-188273 | 9/2013 | | |
| JP | 2014-001984 | 1/2014 | | |
| JP | WO2014024393 A1 * | 2/2014 | | D06F 58/04 |
| JP | 2014-100600 | 6/2014 | | |
| JP | 2015-043826 | 3/2015 | | |
| KR | 20-1999-0013707 | 4/1999 | | |
| KR | 20-1999-0029441 | 7/1999 | | |
| KR | 20-2000-0000962 | 1/2000 | | |
| KR | 20-0228519 | 9/2001 | | |
| KR | 20-0245382 | 10/2001 | | |
| KR | 10-2002-0048576 | 6/2002 | | |
| KR | 20-0281165 | 7/2002 | | |
| KR | 10-2003-0011457 | 2/2003 | | |
| KR | 10-0465690 | 1/2005 | | |
| KR | 10-2006-0109164 | 10/2006 | | |
| KR | 10-0662289 | 12/2006 | | |
| KR | 10-0662289 | 1/2007 | | |
| KR | 10-2007-0060063 | 6/2007 | | |
| KR | 10-0730925 | 6/2007 | | |
| KR | 10-0741111 | 7/2007 | | |
| KR | 10-2008-0000442 | 1/2008 | | |
| KR | 10-0790539 | 1/2008 | | |
| KR | 10-2008-0058123 | 6/2008 | | |
| KR | 10-2009-0115005 | 11/2009 | | |
| KR | 10-2010-0120049 | 11/2010 | | |
| KR | 10-2011-0012307 | 2/2011 | | |
| KR | 10-2011-0067886 | 6/2011 | | |
| KR | 10-2011-0129902 | 12/2011 | | |
| KR | 10-2011-0130089 | 12/2011 | | |
| KR | 10-1097306 | 12/2011 | | |
| KR | 10-2014-0015017 | 2/2014 | | |
| KR | 10-2014-0016197 | 2/2014 | | |
| KR | 10-2015-0006262 | 1/2015 | | |
| KR | 10-2015-0006264 | 1/2015 | | |
| KR | 10-2015-0061144 | 6/2015 | | |
| KR | 10-2015-0066140 | 6/2015 | | |
| KR | 10-2015-0090754 | 8/2015 | | |
| KR | 10-2015-0120230 | 10/2015 | | |
| KR | 10-2015-0138903 | 12/2015 | | |
| WO | WO 0214593 | 2/2002 | | |
| WO | WO2005075727 A1 * | 8/2005 | | D06F 37/28 |
| WO | WO 2010/094959 | 8/2010 | | |
| WO | WO 2010/128729 | 11/2010 | | |
| WO | WO 2011/014018 | 2/2011 | | |
| WO | WO 2011/149319 | 12/2011 | | |
| WO | WO 2016/078191 | 5/2016 | | |

OTHER PUBLICATIONS

CN201103058Y Translated Description, 11 pages (Year: 2008).*
KR20150006264 Translated Description, 9 pages (Year: 2015).*
Chinese Office Action dated May 27, 2017 issued in Application No. 201610457444.7 (with English translation).
Chinese Office Action dated Jun. 26, 2017 issued in Application No. 201610452893.2 (with English translation).
Chinese Office Action dated Aug. 3, 2017 issued in Application No. 201610509856.0 (with English translation).
European Search Report dated Mar. 29, 2017 issued in Application No. 16196148.7.
European Search Report dated Mar. 31, 2017 issued in Application No. 16196150.3.
European Search Report dated Apr. 3, 2017 issued in Application No. 16196149.5.
European Search Report dated Apr. 5, 2017 issued in Application No. 16196185.9.
European Search Report dated Apr. 9, 2017 issued in Application No. 16196353.3.

(56) References Cited

OTHER PUBLICATIONS

European Search Report dated Apr. 10, 2017 issued in Application No. 16196360.8.
European Search Report dated Apr. 11, 2017 issued in Application No. 16196340.0.
European Search Report dated Apr. 11, 2017 issued in Application No. 16196351.7.
European Search Report dated Apr. 18, 2017 issued in Application No. EP16196298.0.
Chinese Office Action dated May 3, 2017 issued in Application No. 201610452886.2 (with English Translation).
Chinese Office Action dated Sep. 28, 2017 issued in Application No. 201610460998.2 (with English Translation).
Chinese Office Action dated Oct. 10, 2017 issued in Application No. 201610461531.X (with English Translation).
Chinese Office Action dated Oct. 18, 2017 issued in Application No. 201610482128.5 (with English Translation).
U.S. Office Action dated Sep. 25, 2017 issued in U.S. Appl. No. 15/340,235.
U.S. Office Action dated Sep. 28, 2017 issued in U.S. Appl. No. 15/338,874.
U.S. Notice of Allowance dated Jan. 23, 2018 issued in U.S. Appl. No. 15/338,874.
U.S. Notice of Allowance dated Mar. 2, 2018 issued in U.S. Appl. No. 15/337,689.
U.S. Notice of Allowance dated Mar. 16, 2018 issued in U.S. Appl. No. 15/337,206.
U.S. Office Action dated Mar. 22, 2018 issued in U.S. Appl. No. 15/337,586.
U.S. Office Action dated Apr. 6, 2018 issued in U.S. Appl. No. 15/335,852.
Machine English Translation of KR 1020150006264 (Year: 2015).
U.S. Office Action dated Nov. 30, 2017 issued in U.S. Appl. No. 15/337,689.
U.S. Office Action dated Dec. 29, 2017 issued in U.S. Appl. No. 15/337,206.
U.S. Office Action dated Jan. 25, 2018 issued in U.S. Appl. No. 15/340,235.
U.S. Office Action dated Feb. 22, 2018 issued in U.S. Appl. No. 15/339,265.
U.S. Office Action dated Sep. 13, 2018 issued in co-pending related U.S. Appl. No. 15/914,494.
U.S. Notice of Allowance dated Sep. 25, 2018 issued in co-pending related U.S. Appl. No. 15/335,852.
Russian Office Action (with English translation) dated Dec. 21, 2018 issued in RU Application No. 2018120146.
Japanese Office Action dated May 7, 2019 issued in JP Application No. 2018-522076.

* cited by examiner

LAUNDRY TREATING APPARATUS

CROSS-REFERENCE TO RELATED APPLICATION(S)

Pursuant to 35 U.S.C. § 119(a), this application claims the benefit of earlier filing date and right of priority to U.S. Provisional Application No. 62/249,355, filed on Nov. 2, 2015, Korean Applications Nos. 10-2016-0001184 filed on Jan. 5, 2016, and 10-2016-0040456 filed on Apr. 1, 2016, the contents of which is incorporated by reference herein in its entirety.

BACKGROUND

1. Field

A laundry treating apparatus, and more particularly, a laundry treating apparatus having a door for opening and closing a laundry introduction opening of a body is disclosed herein.

2. Background

A laundry treating apparatus may include a laundry washing apparatus, a laundry drying apparatus, or a laundry washing/drying apparatus. In the laundry treating apparatus, a washing process may remove contaminants of laundry by interaction between water and detergent, and a drying process may remove moisture included in laundry by a hot blast supply device provided at the laundry treating apparatus. A general laundry treating apparatus may include a body which forms the appearance of the laundry treating apparatus and has a laundry introduction opening, a laundry accommodation unit or device provided in the body, a driving unit to rotate a drum which constitutes the laundry accommodation unit, and a door to open and close the laundry introduction opening.

In the general laundry treating apparatus, the door may be designed to open and close the laundry introduction opening, and to allow a user to view the laundry accommodation unit therethrough. In this case, an open angle of the door may be restricted due to a limited design of the laundry treating apparatus. In order to solve such a problem, Korean Laid-Open Utility Model No. 20-1999-0029441, etc. has disclosed a structure to open and close a door in a drum-type washing machine with an increased open angle. However, the structure has a degraded appearance due to the quadrangular door and fixing plate of a hinge unit. Further, since the hinge unit has a simple structure, reliability in opening the door or durability of the hinge unit may be lowered.

The case of a concaved-type door having no gap between its outer surface and a front surface of a laundry treating apparatus, the conventional door opening/closing structure may not be applied, because a large open angle should be implemented with a simple appearance of the laundry treating apparatus and an operation reliability should be implemented. Further, in the case of a door asymmetric with a laundry introduction opening (e.g., a circular door having a display unit), a mechanism to open and close the door should be considered. Thus, the present disclosure provides a method capable of enhancing an operation reliability, while maintaining a simple appearance of a laundry treating apparatus.

BRIEF DESCRIPTION OF THE DRAWINGS

Embodiments will be described in detail with reference to the following drawings in which like reference numerals refer to like elements, and wherein.

DETAILED DESCRIPTION

Figure 1:
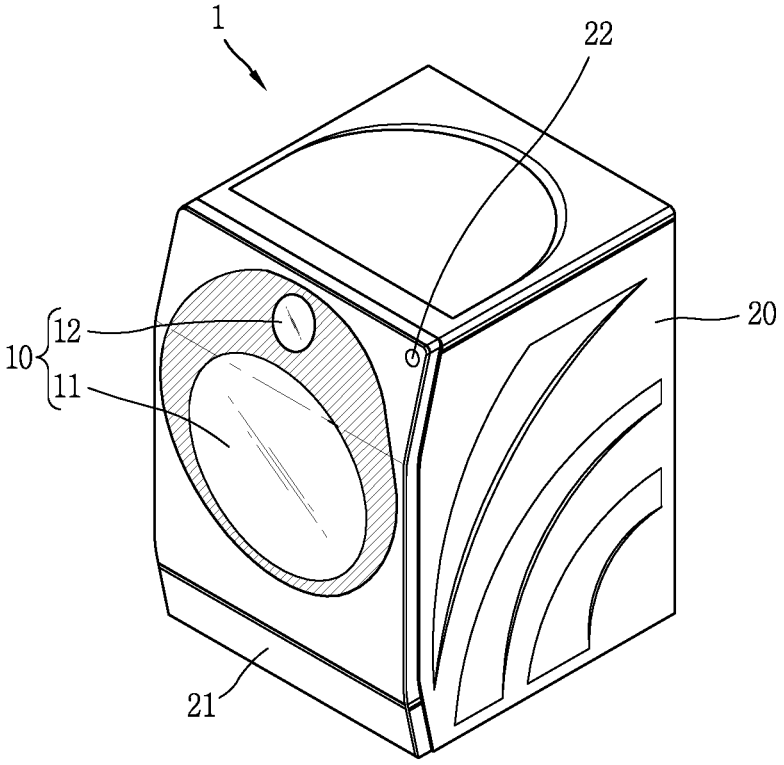
FIG. 1 is a perspective view illustrating a laundry treating apparatus according to an embodiment of the present invention.

Referring to the drawings, the laundry treating apparatus 1 may include a body 20 and a door 10. The body 20 may form an appearance of the laundry treating apparatus 1, and may be provided with the laundry introduction opening 20*a* into which laundry is introduced. In this embodiment, the laundry introduction opening 20*a* may be formed on a front surface of the body 20 having a hexahedral shape.

A laundry accommodation unit or space, configured to accommodate laundry therein through the laundry introduction opening 20*a*, is provided in the body 20. If the laundry treating apparatus 1 serves to dry laundry, the laundry accommodation unit may be configured as a drum 40 rotatably provided in the body 20. If the laundry treating apparatus 1 serves to wash and dry laundry, the laundry accommodation unit may be configured as a tub provided in the body 20 and configured to store washing water therein, and a drum 40 rotatably provided in the tub and configured to accommodate laundry therein.

A driving unit configured to rotate the drum 40 may be provided at the body 20. The driving unit may include a motor configured to generate a driving force, and a belt configured to rotate the drum 40 using the driving force. A detergent supply unit or device may be installed at the body 20 to be withdrawable and insertable, in the form of a drawer. A cover 21 configured to cover the detergent supply unit may be formed to be rotatable up and down.

A power button 22, configured to turn on/off the laundry treating apparatus 1, may be provided at the body 20. When a display unit or display 12 is configured as a touch screen 12, the laundry treating apparatus 1 may be turned on/off by a touch input applied to the touch screen 12. In this case, the power button 22 is not provided.

The door 10 may be provided with a window unit 11 and the display unit 12. In a closed state of the door 10, the window unit 11 may correspond to the laundry introduction opening 20*a*. With such a configuration, a user may check a state of laundry accommodated in the laundry accommodation unit through the window unit 11.

The display unit 12 displays or outputs information processed by the laundry treating apparatus 1. The display unit 12 may display execution screen information about processes executed by the laundry treating apparatus 1, such as a washing process, a dehydrating process, a drying process, or the like, or User Interface (UI) information and Graphic User Interface (GUI) information corresponding to the execution screen information.

The door 10 may be installed by a hinge unit 30 (or a hinge) so as to be rotatable with respect to the body 20. The door 10 may be configured to open and close the laundry introduction opening 20*a*. In a state where the hinge unit 30 is mounted to a first side of the door 10, a locking device to fix the door 10 to the body 20 or to separate the door 10 from the body 20 may be provided at a second side of the door 10. The locking device may be formed as a press-type. The door 10 may be locked when the second side thereof is pressed once, and may be unlocked when the second side is pressed again.

As shown, the body 20 may be provided with a door accommodation unit (or door accommodated space) 20*b*-recessed inward from an outer surface of the body 20 and having the laundry introduction opening 20*a* therein. The door 10 may be accommodated in the door accommodation unit 20*b* in a closed state, and may be separated from the door accommodation unit 20*b* in an open state. With such a configuration, the door 10 is may open the laundry introduction opening 20*a* in an open state, and to block the laundry introduction opening 20*a* in a closed state.

Figure 2A:
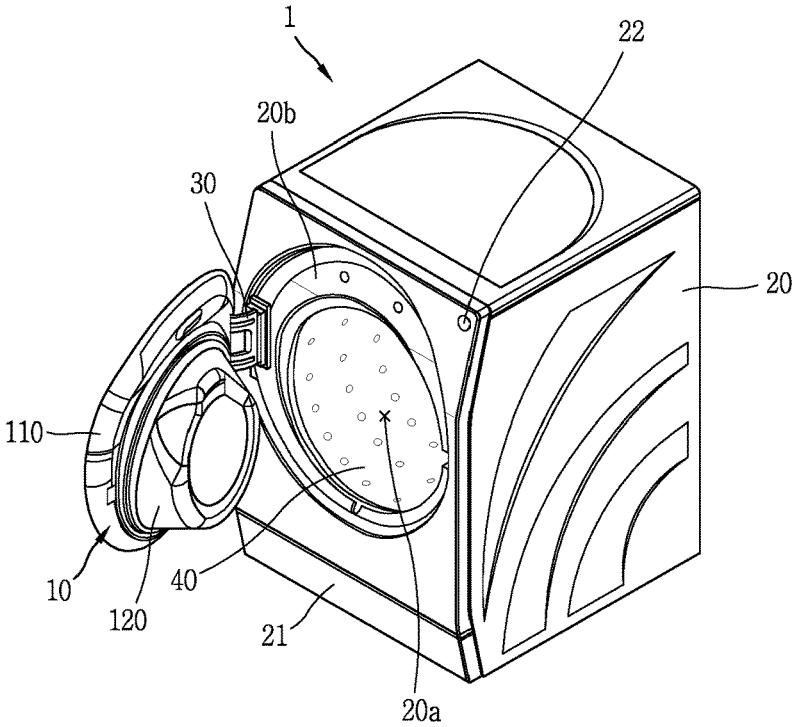
FIG. 2A is a conceptual view illustrating an open state of a laundry introduction opening, the open state implemented as a door shown in FIG. 1 primarily rotated.
Figure 2B:
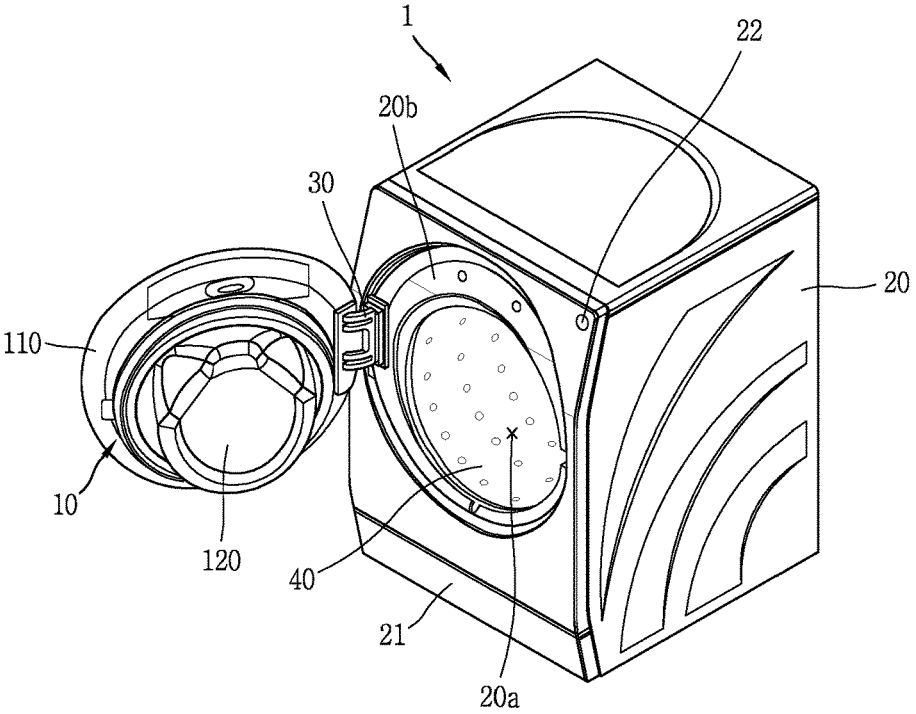
FIG. 2B is a conceptual view illustrating a secondarily rotated state of the door shown in FIG. 2A.

When the door 10 is accommodated in the door accommodation unit 20*b*, the hinge unit 30 may have a dual hinge structure having two different rotation shafts, in order to prevent the door 10 from being locked by the body 20 when the door 10 is open. In this case, as shown in FIGS. 2A and 2B, the door 10 may be separated from the door accommodation unit 20*b* by a primary rotation about a first rotation shaft, and may rotate by a secondary rotation about a second rotation shaft.

According to such a dual hinge structure, a mechanism may be implemented to open the laundry introduction opening as the door is rotated by more than 90°. The mechanism may be also applied to a concaved-type door having a large size and no gap between an outer surface of the door and a front surface of the body (i.e., a concaved-type door having its outer surface not protruding from the door accommodation unit).

Hereinafter, a detailed structure of the door 10 will be explained on the basis of such a dual hinge structure. The laundry introduction opening may be formed to have a circular shape, and the door 10 may also be formed to have a circular shape (including a perfect circle and an oval shape) in correspondence to the laundry introduction opening. However, the present disclosure is not limited to this. The laundry introduction opening and the door 10 may be formed to have a polygonal shape (a quadrangular shape, a hexagonal shape, or the like).

Referring to the drawings, the door 10 may include a door frame 110, a door window 120 and a door cover 140. The door frame 110 may be provided with an opening 110*a* which faces the laundry introduction opening 20*a* in a closed state of the door 10. The door window 120 may be installed at the door frame 110 to correspond to the opening 110*a*. The door window 120 may be formed of a transmissive material (glass, synthetic resin, etc.), and may be provided to correspond to the laundry introduction opening 20*a* in a closed state of the door 10.

As shown, the door frame 110 may include an outer frame 111 and an inner frame 112. The outer frame 111 and the inner frame 112 may be formed of a synthetic resin (e.g., an ABS material, a PC material, etc.).

The door window 120 may be mounted to the door frame 110. The door window 120 may be formed of a transmissive material (glass, synthetic resin, etc.), and may be provided to correspond to the laundry introduction opening 20*a* in a closed state of the door 10. The door cover 140 which forms an appearance of the door 10 may be coupled to the door frame 110. The door cover 140 may be formed of glass or a synthetic resin having a transmissive characteristic.

In this embodiment, the door frame 110 and the door cover 140 may be formed to have a circular shape, in correspondence to the door 10 having a circular shape. As shown, the door frame 110 may be rotatably coupled to the body 20, and the hinge unit 30 may be coupled to each of the door frame 110 and the body 20. In this case, the hinge unit 30 may be mounted to the body 20 from the upper side, on the basis of the center of the circular door 10.

Figure 4A:
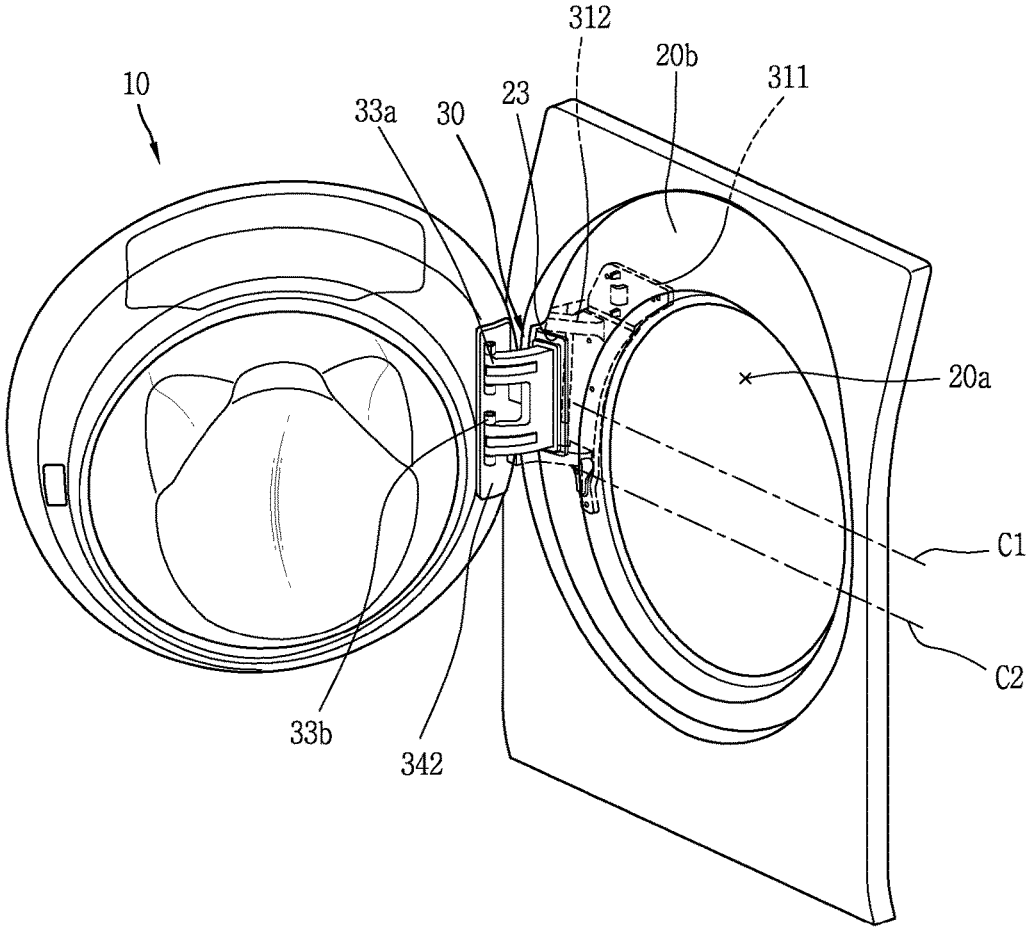
FIGS. 4A and 4B are conceptual views illustrating a coupled state between the door and a hinge unit.
Figure 4B:
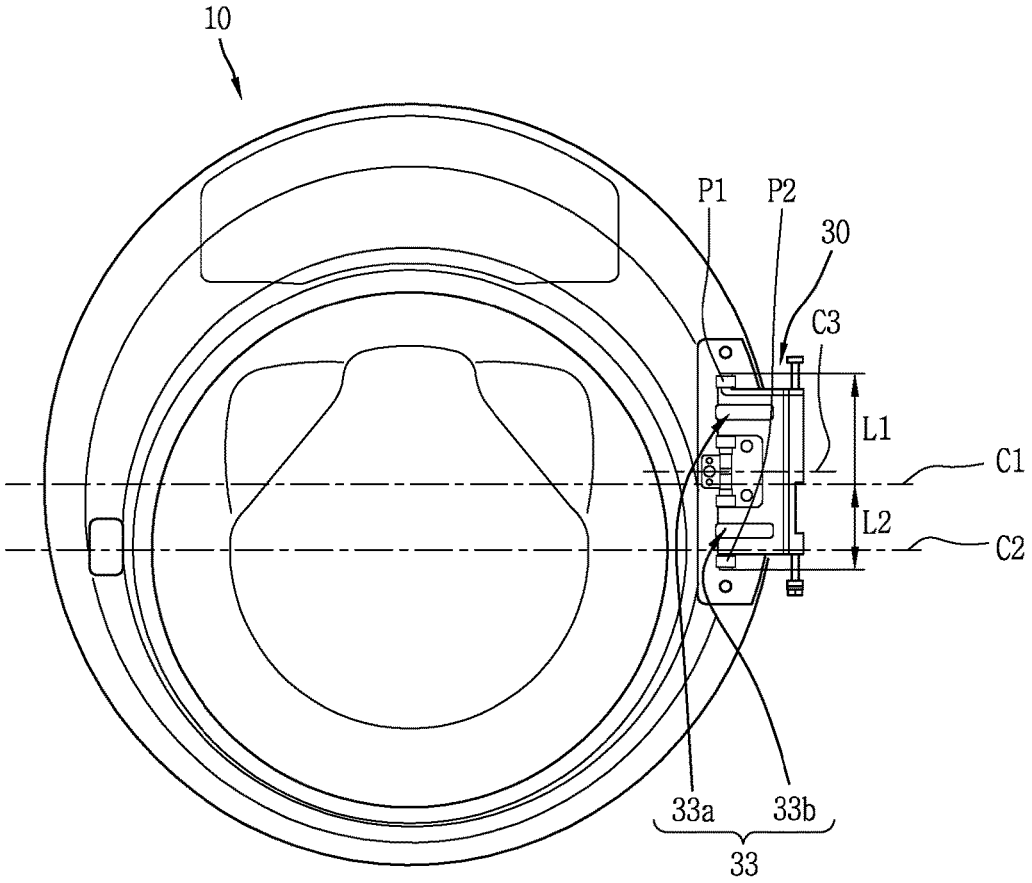

The door 10 may be rotatably connected to the hinge unit 30 at connection points (P1, P2) asymmetric to each other based on a horizontal center line (C1) of the door 10. The hinge unit 30 may be disposed to be eccentric from a horizontal center line (C2) of the laundry introduction opening 20*a*. Referring to FIGS. 4A and 4B, both of the door 10 and the laundry introduction opening 20*a* may be formed to have a circular shape. However, the door 10 and the laundry introduction opening 20*a* may be formed to be eccentric from each other, since the display unit 12 may be provided at one side of the door 10.

For a door opening structure in such an asymmetric structure, the hinge unit 30 may be provided eccentric upward based on the horizontal center line (C2) of the laundry introduction opening 20*a*, and may have a specific structure. The door 10 may be rotatably connected to the hinge unit 30 at the connection points (P1, P2) asymmetric to each other based on the horizontal center line (C1) of the door 10, through a connection unit 33.

The connection unit 33 may be provided with an upper connection part 33*a* and a lower connection part 33*b* provided at upper and lower sides based on the horizontal center line (C1) of the door 10. In this case, each of the upper connection part 33*a* and a lower connection part 33*b* may be provided with one or more connection portions. As shown, the upper connection part 33*a* and the lower connection part 33*b* may be arranged to be asymmetric to each other, based on the horizontal center line (C1) of the door 10.

Figure 5A:
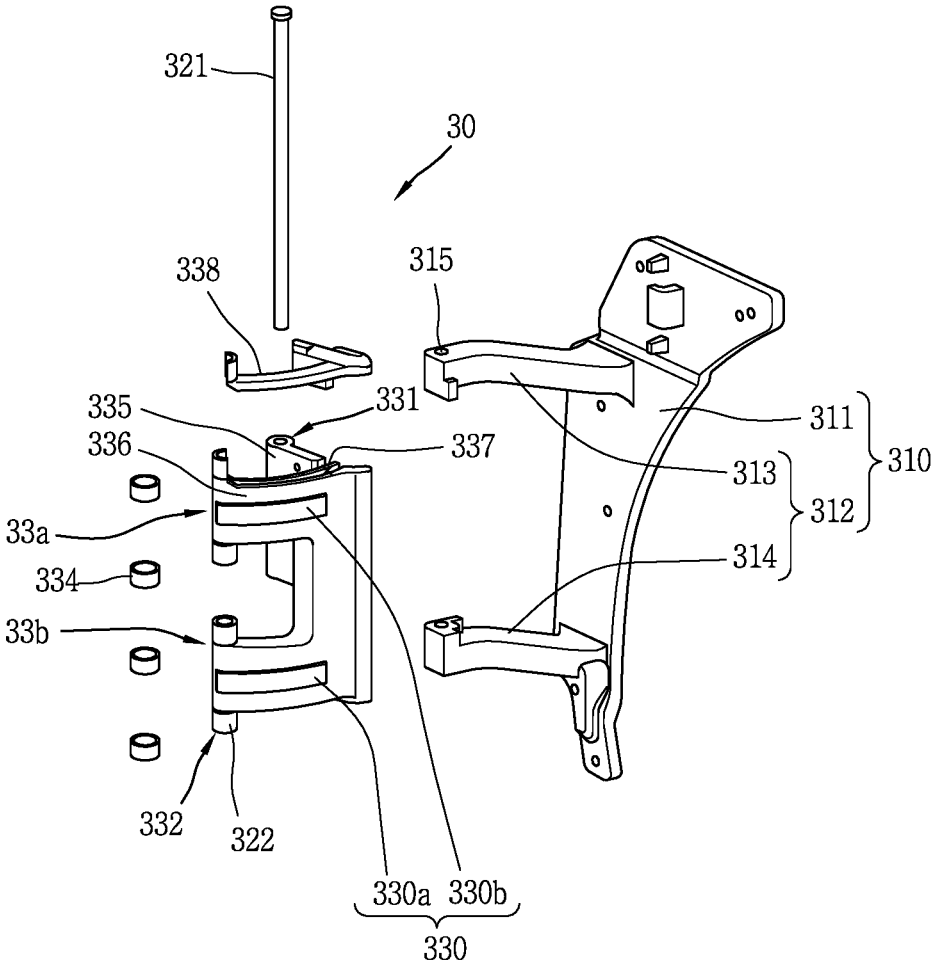
FIG. 5A is an exploded perspective view of the hinge unit shown in FIG. 3A.
Figure 5B:
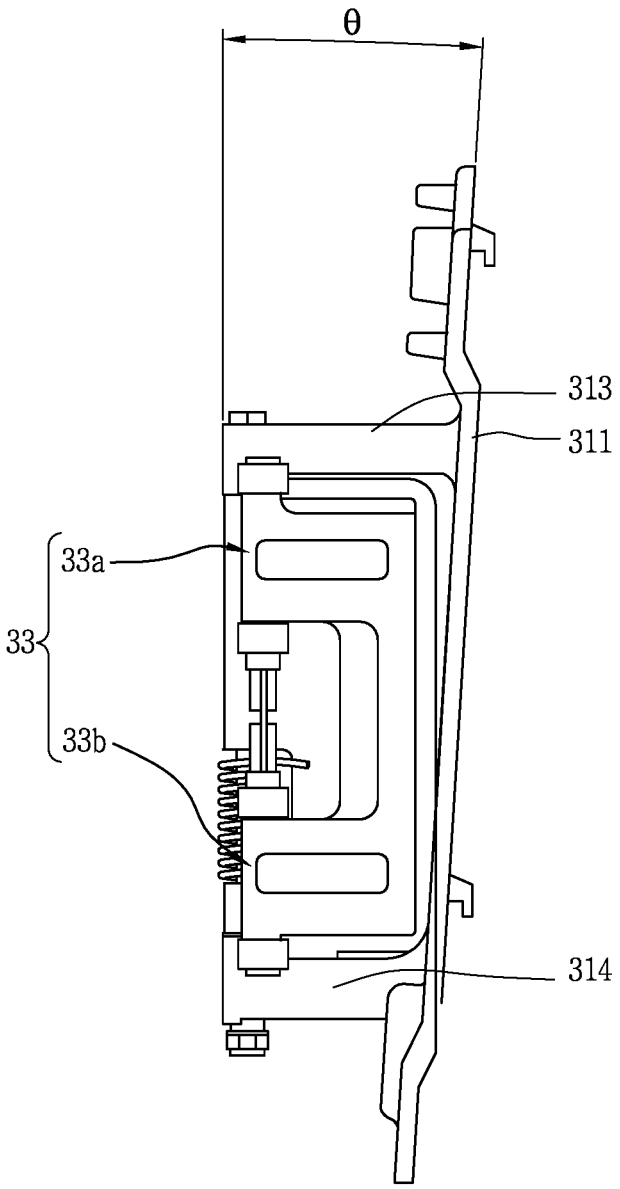
FIG. 5B is a side sectional view of the hinge unit shown in FIG. 3A.
Figure 5C:
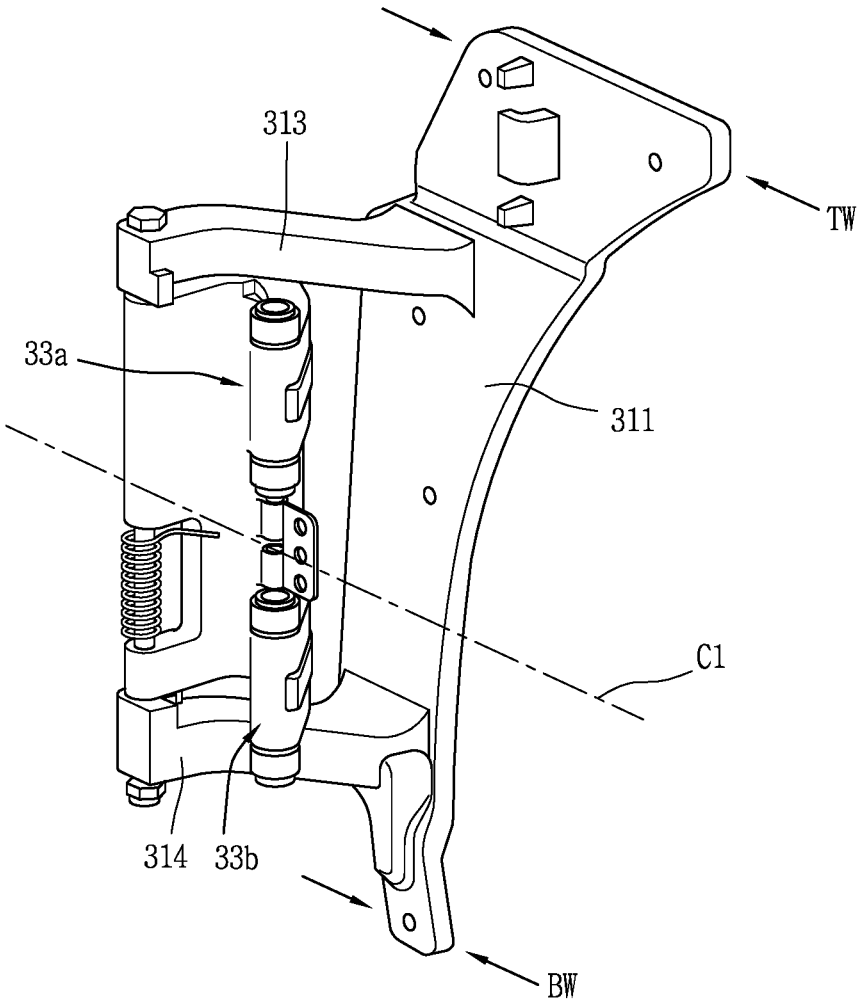
FIG. 5C is a perspective view of the hinge unit shown in FIG. 3A.

The connection point P1 may be defined as an upper end of the upper connection part 33*a*, and the connection point P2 may be defined as a lower end of the lower connection part 33*b*. For instance, the connection point P1 may be a position of a bushing 334 to be explained later (refer to FIG. 5A) which may be provided at the upper end of the upper connection part 33*a*, and the connection point P2 may be a position of a bushing 334 to be explained later (refer to FIG. 5A) which may be provided at the lower end of the lower connection part 33*b*.

Alternatively, the connection point P1 may be defined as a central region (center) of the upper connection part 33*a*, and the connection point P2 may be defined as a central region (center) of the lower connection part 33*b*. In this case, the connection point P1 may be an intermediate region between bushings of the upper connection part 33*a*, and the connection point P2 may be an intermediate region between bushings of the lower connection part 33*b*.

More specifically, a distance (L1) from the horizontal center line (C1) of the door 10 to the upper connection part 33*a* may be longer than a distance (L2) from the horizontal center line (C1) of the door 10 to the lower connection part 33*b*. In this case, an intermediate region (C3) between the upper connection part 33*a* and the lower connection part 33*b* may be positioned above the horizontal center line (C1) of the door 10.

A door opening/closing structure suitable for a case where a circular door and a circular laundry introduction opening are eccentric from each other and the door is provided with a display unit, may be provided by arranging the hinge unit 30 on a position eccentric from the door 10. A geometric center or a weight center of the hinge unit 30 may be eccentric based on the horizontal center line (C1) of the door 10, or the horizontal center line (C2) of the laundry introduction opening 20*a*.

The door accommodation unit 20*b* may be provided with through holes 23, and the hinge unit 30 may be blocked by the door accommodation unit 20*b*. The connection unit 33 of the hinge unit may be exposed to the door accommodation unit 20*b* via the through holes 23. Like the connection unit 33, the through holes 23 of the door accommodation unit 20*b* may be asymmetric to each other up and down, based on the horizontal center line (C1) of the door 10. Accordingly, regions of the hinge unit 30, exposed to the door accommodation unit 20*b* via the through holes 23, may be asymmetric to each other based on the horizontal center line (C2) of the laundry introduction opening 20*a*. In this case, a center of the exposed regions may be arranged above the horizontal center line (C2) of the laundry introduction opening 20*a*.

With such an eccentric structure, the hinge unit may enhance reliability at the time of supporting the door eccentric from the laundry introduction opening and having a greater weight at an upper part thereof. The hinge unit having an eccentric structure may be applied to not only a single hinge structure, but also the aforementioned dual hinge structure. A detailed structure of the hinge unit 30 will be explained later.

A front cover 21 may be mounted to a front surface of the body 20, and the hinge unit 30 may be mounted to the inside of the body 20 to be connected to the door 10 through the front cover 21. As shown, the door accommodation unit 20*b* aforementioned with reference to FIGS. 1 and 2 may be formed at the front cover 21 together with the laundry introduction opening 20*a*. The door 10 may be provided so as to be accommodated in the door accommodation unit 20*b*, and such that an outer edge of the door 10 may have the same plane as an outer surface of the body 20 adjacent to the door 10, in a closed state.

The through hole 23 may be formed on a side wall of the door accommodation unit 20*b*, the hinge unit 30 may be mounted to a hinge bracket of the body 20, and at least part of the hinge unit 30 may be exposed to the door accommodation unit 20*b* via the through hole 23. The hinge bracket may be configured to connect the laundry treating apparatus to the hinge unit 30. The hinge bracket may be provided at an upper side on the basis of the center of the laundry introduction opening 20*a*.

Accordingly, the hinge unit 30 may be provided on a position eccentric from the laundry introduction opening 20*a*. As previously described with reference to FIGS. 1 and 2, the hinge unit 30 may have a dual hinge structure having two different rotation shafts. With such a structure, the door 10 may be rotated by more than 90° to be separated from the door accommodation unit 20*b*. Hereinafter, the structure of the hinge unit 30 will be explained in more detail with reference to FIGS. 5A-5C and 6A-6D, together with FIGS. 1 and 2.

Referring to the drawings, the hinge unit 30 may be provided with a mounting portion 311 mounted to the body. And the mounting portion 311 may be formed such that a width (BW) of a lower end region of the mounting portion 311 may be narrower than a width (TW) of an upper end region of the mounting portion 311. The width may mean a distance in right and left directions when the door is viewed from a front side. The mounting portion 311 may be formed such that a lower area thereof may be smaller than an upper area of the mounting portion 311 based on the horizontal center line (C1) of the door 10. With such a configuration, a center of figure or a weight center of the mounting portion 311 may be positioned above the horizontal center line (C1) of the door 10.

Furthermore, the mounting portion 311 may be formed such that a length from the horizontal center line (C1) of the door 10 to an upper end of the mounting portion 311 may be longer than a length from the horizontal center line (C1) of the door 10 to a lower end of the mounting portion 311. The mounting portion 311 may be positioned to be biased based on the horizontal center line (C1) of the door 10.

The structure of the mounting portion 311 is related to the aforementioned hinge unit biased based on the horizontal center line (C1) of the door 10, and may be applicable to a dual hinge structure to be explained later. More specifically, the hinge unit 30 may be provided with a base member 310 having the mounting portion 311.

The base member 310 may be formed of a metallic material having a strength high enough to support the door, and having durability large enough not to be transformed when the door is open and closed. The base member 310 may include a protrusion portion 312 protruding from the mounting portion 311. For instance, a plurality of protrusions 313, 314 may protrude from the mounting portion 311, to be asymmetric to each other based on the horizontal center line (C1) of the door 10.

The mounting portion 311 may be mounted to the body of the laundry treating apparatus, e.g., the hinge bracket. Since the hinge unit 30 is provided on a position eccentric from the laundry introduction opening 20*a*, the base member 310 may be mounted to the body (more specifically, the hinge bracket) to be upward-biased based on the horizontal center line (C1) of the door 10. The base member 310 may be mounted to the body in a state where an intermediate region between the plurality of protrusions 313, 314 is provided above the horizontal center line (C2) of the laundry introduction opening 20*a*.

The mounting portion 311 may be formed as a plate member, and may be formed such that a first edge of the mounting portion 311 may have a circular arc in correspondence to the shape of the laundry introduction opening 20*a*. Since the base member 310 is positioned above the center of the circular laundry introduction opening 20*a*, the first edge may be formed along a circular arc positioned on the left upper side of the circular laundry introduction opening 20*a*.

The protrusion portion 312 may be configured as cantilevers protruding from the mounting portion 311. In this case, the protrusion portion 312 may protrude to form an obtuse angle with the mounting portion 311. For instance, the protrusion portion 312 may extend in a diameter direction of the laundry introduction opening, and may extend toward a front surface of the body 20. The protrusion portion 312 may extend towards a front surface of the body 20, in an inclined state from the mounting portion 311, thereby protruding to the door accommodation unit 20*b* via the through hole 23 of the front cover 21.

The protrusion portion 312 may include a first protrusion 313 and a second protrusion 314 spaced from each other. As shown, the first protrusion 313 may be provided above the horizontal center line (C1) of the door 10, and the second protrusion 314 may be provided below the horizontal center line (C1) of the door 10. The first and second protrusions 313, 314 may be coupled to a first connection part to be explained later.

As previously mentioned, the mounting portion 311 may be formed such that a width of a lower end region of the mounting portion 311 may be narrower than a width of an upper end region thereof. The upper end region may indicate a region close to an upper end of the mounting portion 311. The upper end region may be formed between the first protrusion 313 and the upper end of the mounting portion 311. Likewise, the lower end region may indicate a region close to a lower end of the mounting portion 311. The lower end region may be formed between the second protrusion 314 and the lower end of the mounting portion 311.

Both of the first and second protrusions 313, 314 may be provided above a center of the laundry introduction opening 20*a*. The first protrusion 313 and the second protrusion 314 may be spaced from each other on the mounting portion 311, and the mounting portion 311 may be formed such that its width may become narrower toward the second protrusion 314 from the first protrusion 313. For instance, a width of the mounting portion 311 corresponding to the first protrusion 313 is formed to be greater than a width of the mounting portion 311 corresponding to the second protrusion 314. More specifically, a width of the mounting portion 311 around the first protrusion 313 may be formed to be greater than a width of the mounting portion 311 around the second protrusion 314.

Since the first edge of the mounting portion 311 may form a circular arc, a second edge of the mounting portion 311 may form a straight line in a vertical direction, which may change of the width of the mounting portion 311. With such a configuration, the width of the mounting portion 311 may become narrower toward the center of the laundry introduction opening 20*a* from the upper side.

The mounting portion 311 may be formed such that its surface mounted to the body may be inclined. At least part of the mounting portion 311 may be inclined from a rotation shaft of the connection unit 33, such that the lower end region of the mounting portion 311 is closer to the connection unit 33 than the upper end region of the mounting portion 311. The connection unit 33 may be provided in a vertical direction, and the mounting portion 311 may be inclined from the vertical direction by a preset angle (8). As shown, in FIG. 5B each of the upper end region, the lower end region, and a region between the first and second protrusions may be inclined. Part of the mounting portion 311 to be mounted to the body may also be inclined.

An insertion hole 315 into which a hinge shaft may be inserted 'may be formed at the end of each of the first protrusion 313 and the second protrusion 314. The hinge shaft may be provided at a fixed position with respect to the body 20, and may form one of two rotation shafts by a dual hinge structure. Thus, the hinge shaft may be referred to as a first rotation shaft 321.

As shown, the hinge unit 30 may be provided with a connection member 330, and the connection member 330 may be rotatably connected to the protrusion portion 312. The connection member 330 may be rotatably connected to the protrusion portion 312 such that a rotation center of the door may be moveable.

The first rotation shaft 321 may be a fixed shaft to which the connection member 330 is rotatably connected. The connection member 330 may be configured to move a rotation center of the door 10 between a closed state and an open state of the door 10. For instance, a first connection part 331 of the connection member 330 may be connected to the base member 310, and the door may be rotatably connected to a second connection part 332 of the connection member 330.

In a biased-hinge structure, the aforementioned connection unit 33 may be the second connection part 332. In this case, the protrusion portion 312 may be the connection member 330 as the door is rotatably coupled to one end of the protrusion portion 312. A region of the hinge unit 30, exposed to the door accommodation unit via the through hole 23, may be part of the protrusion portion and the connection unit provided at the end of the protrusion portion. The part of the protrusion portion and the connection unit may be arranged to be asymmetric to each other based on the horizontal center line of the door.

In a dual hinge structure, the first connection part 331 may be formed at a first end of the connection member 330, and the first connection part 331 may be rotatably connected to the base member 310 through the first rotation shaft 321. Alternatively, the first connection part 331 may slidably-connect the connection member 330 to the base member 310. In this case, the connection member 330, rather than the first rotation shaft, is slidably-coupled to the protrusion portion of the base member 310. The first connection part 331 may be moveably-coupled to the base member 310.

Figure 3A:
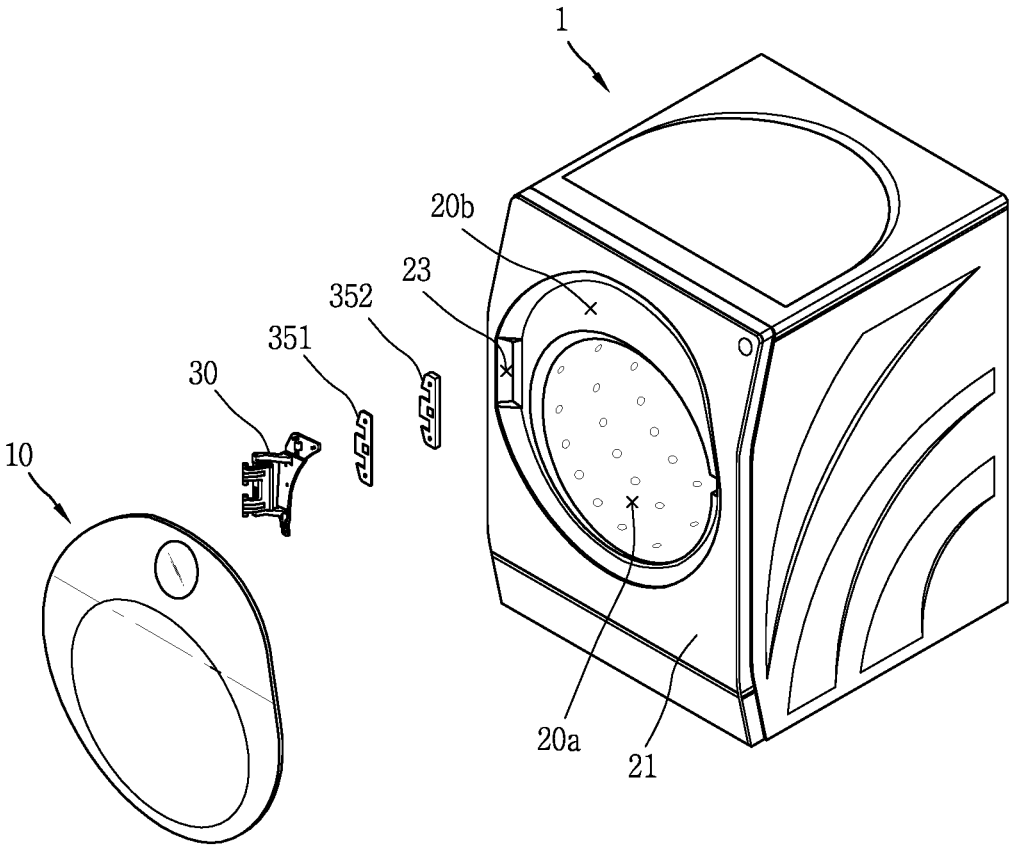
FIG. 3A is an exploded perspective view of the laundry treating apparatus shown in FIG. 1.
Figure 3B:
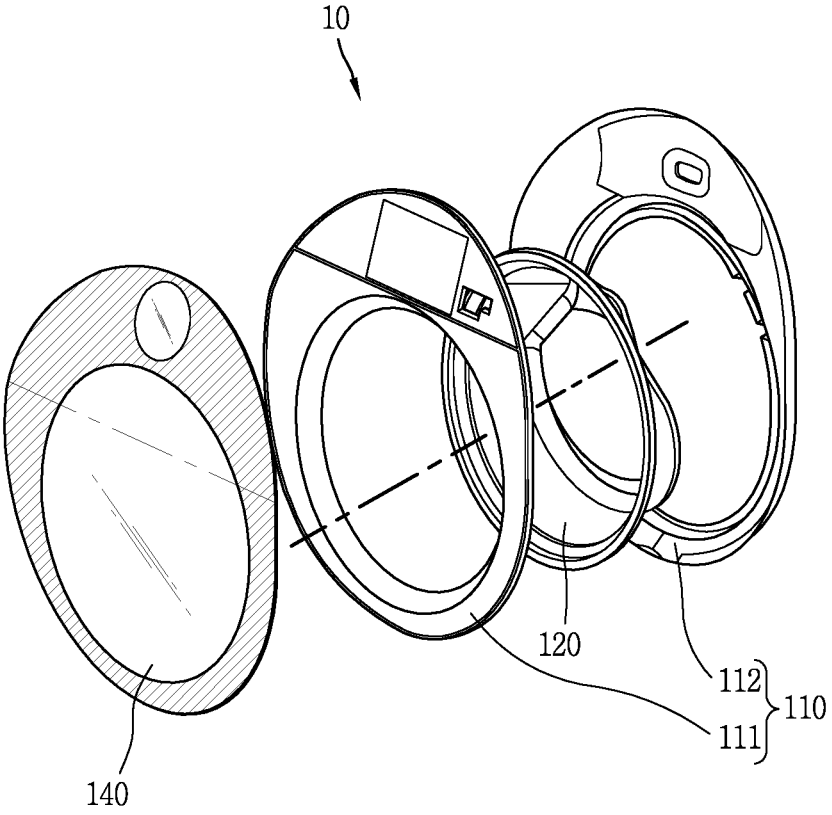
FIG. 3B is an exploded perspective view of the door shown in FIG. 1.

The second connection part 332 may be formed at a second end of the connection member 330, such that a rotation center of the door 10 may be moveable between a closed state and an open state of the door 10. And the door 10 may be rotatably connected to the second connection part 332. As shown, a second rotation shaft 322 may be mounted to the second connection part 332, and the rotation center of the door 10 may be moved from the first connection part (or the first rotation shaft) to the second connection part (or the second rotation shaft). A bushing 334 may be mounted to the second rotation shaft 322, and a hinge holder 351 (refer to FIG. 3A) that couples with the door 10 may be coupled to the bushing 334. The hinge holder 351 may be coupled to the door 10, and a holder cover 352 configured to cover the hinge holder 351 may be mounted to the door 10.

The connection member 330 may include a first member 335 extending in a first direction, and a second member 336 protruding from the end of the first member and extending in a second direction different from the first direction. In this case, the first rotation shaft 321 may be connected to a first end of the first member 335, and the second member 336 may be bent from a second end of the first member 335 toward said second direction. The second rotation shaft 322 may be mounted to the end of the second member 336, and the door may be rotatably coupled to the second rotation shaft 322.

In this case, the first member 335 may be formed as a straight bar, and the second member 336 may be formed as a curved bar. More specifically, the second member 336 may form a circular arc having the first connection part 331 as its center. Accordingly, the second member 336 may extend in a circumferential direction having the first connection part 331 as the center.

The hinge unit 30 may be formed to accommodate therein at least part of an electric wire to electrically connect the display unit 12 (refer to FIG. 1) to a controller (a main printed circuit board) provided at the body. For instance, an accommodation groove 337 configured to accommodate the electric wire therein may be formed on at least part of the hinge unit. The accommodation groove 337 configured to accommodate the electric wire may be formed at the second member 336, and a cover 338 configured to cover the accommodation groove 337 may be mounted to the hinge unit 30. The accommodation groove 337 may extend toward the first member 335, and the electric wire may be connected to the inside of the laundry treating apparatus via the first connection part 331. The electrical wire may serve as a path to electrical connecting the door to the controller inside the laundry treating apparatus.

The connection member 330 may be provided with an upper connection member 330*b* and a lower connection member 330*a* asymmetric to each other based on the horizontal center line of the door. The electric wire may be connected to the body through the upper connection member 330*b*. The accommodation groove 337 configured to accommodate the electric wire therein may be formed at the upper connection member 330*b*. The second member 336 may be provided with an upper member and a lower member provided at upper and lower sides respectively based on the horizontal center line of the door, and the accommodation groove 337 may be formed at the upper member. With such a configuration, a path of the electric wire to connect the inside of the laundry treating apparatus to the outside may be easily obtained.

The first member 335 may protrude from the first connection part 331, toward a direction which becomes closer to a rear surface of the door 10, in a closed state of the door. On the contrary, the second member 336 may protrude from the end of the first member 335, toward a direction which becomes closer to a front surface of the door 10, in a closed state of the door.

The first member 335 and the second member 336 may be arranged to have an acute angle therebetween. The second member 336 may be formed to cross the protrusion. With such a configuration, one side of the second member 336, close to the first connection part 331, may be provided on the right side of the first connection part 331 at the door.

Figure 6A:
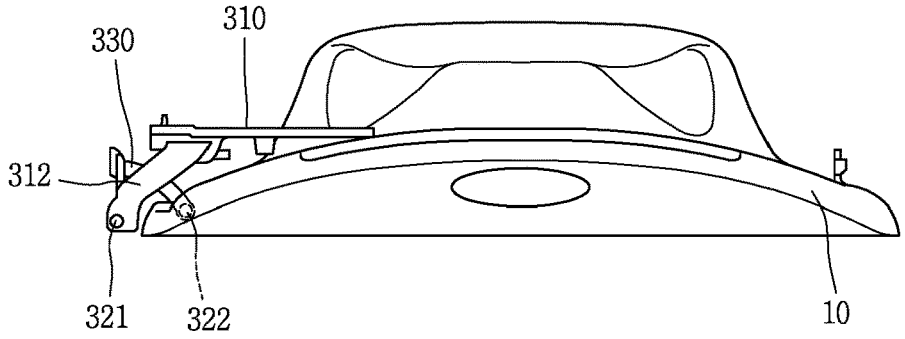
FIGS. 6A to 6D illustrate an operation to open a door by the hinge unit shown in FIG. 5A.

The connection member 330 having the aforementioned structure may be formed to be rotated about the first connection part 331 within a preset range, as the door is rotated from a closed state (refer to FIG. 6A). The first connection part 331 may be formed such that the connection member 330 may be rotated about the first rotation shaft 321 up to a preset angle.

Figure 6B:
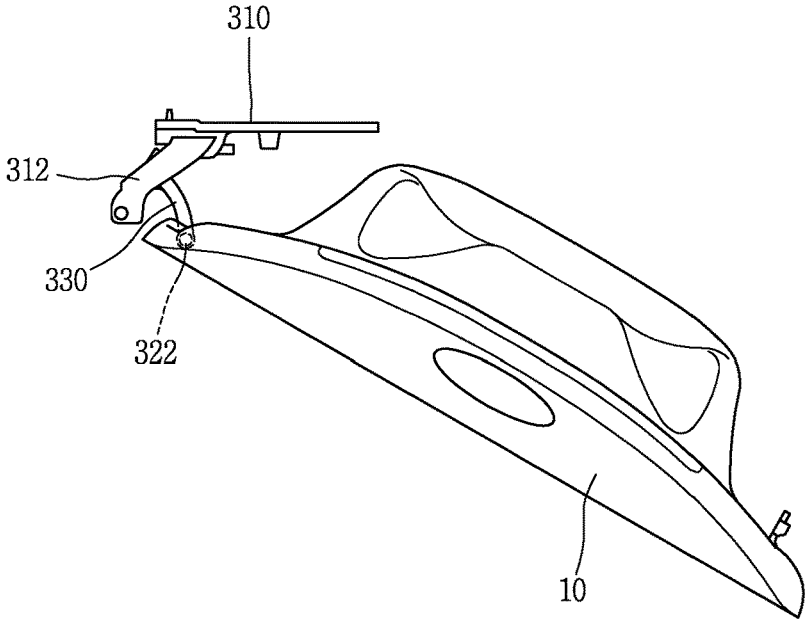
Figure 6C:
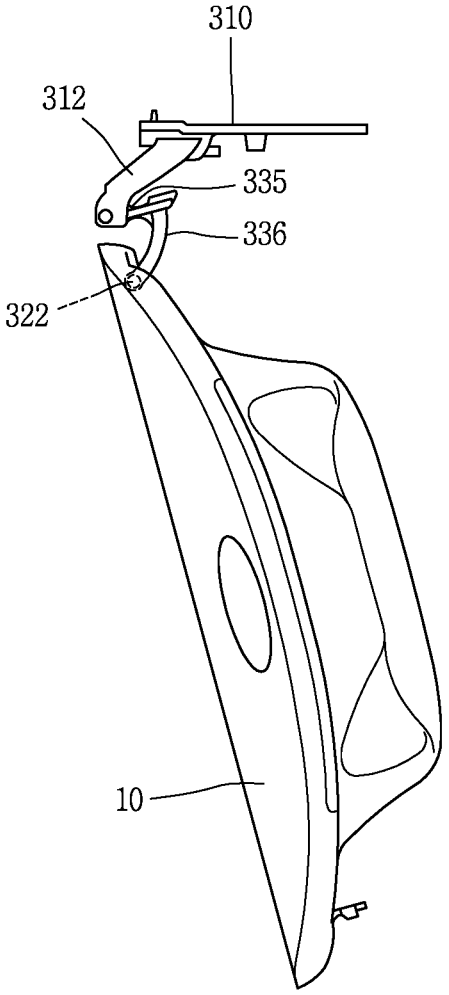

Referring to FIGS. 6A to 6C, at least part of the connection member 330 may be formed to pass through at least part of the base member within the preset range, as the door is rotated. For instance, the second member 336 and the first member 335 may be sequentially rotated via the protrusion.

Once the second member 336 and the first member 335 are sequentially rotated via the protrusion, the door may be opened up to a limit of the preset range (in this embodiment, 75°) (refer to FIG. 6C, this open state will be called an 'intermediate open state'). A stopper, configured to restrict the connection member from being rotated to a door opening direction at the limit, may be provided at the first connection member 331. As shown, in the intermediate open state, the door 10 partially covers the laundry introduction opening 20*a* at the front side.

In this case, the second rotation shaft 322 may be rotated about the first rotation shaft 321 up to the preset angle, as the door 10 is rotated in the intermediate open state. As a result, the second rotation shaft 322 may be moved away from the laundry introduction opening 20*a*.

If the door 10 is continuously rotated about the first rotation shaft 321 in the intermediate open state, one side of the door may be locked by the front cover 21, because there is no gap between the front cover 21 and an outer surface of the door 10. The dual hinge structure may move a rotation center of the door 10 move to the second connection part 332 from the first connection part 331, in the intermediate open state.

Figure 6D:
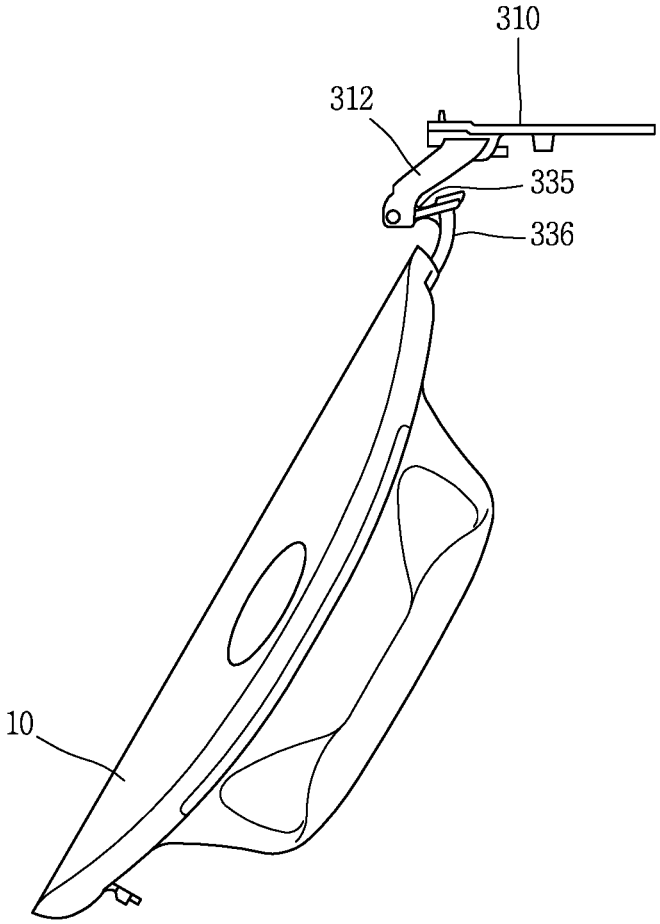
Figure 7:
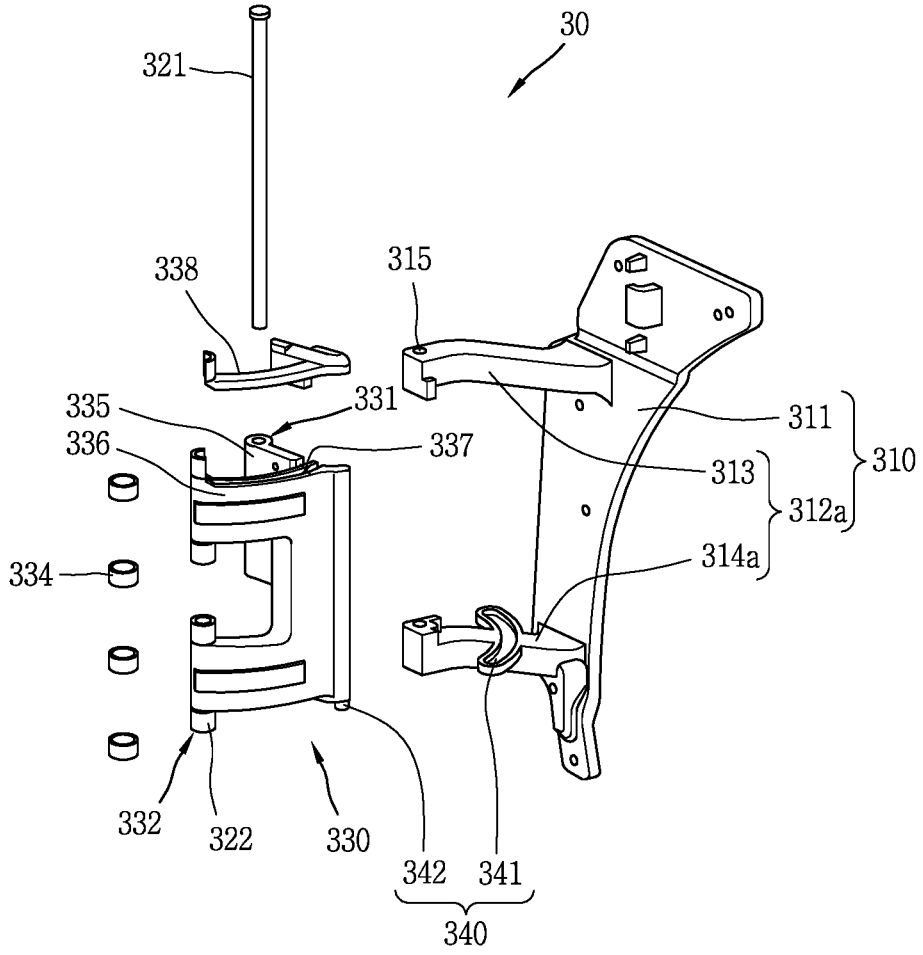
FIG. 7 is an exploded perspective view of the hinge unit according to another embodiment.
Figure 8A:
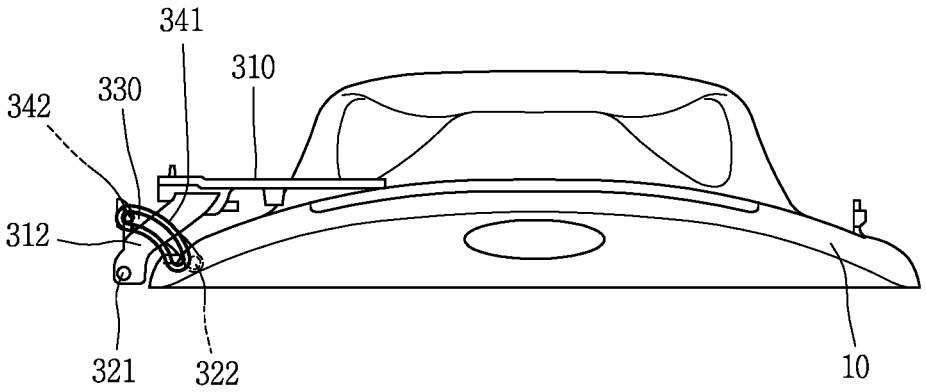
FIGS. 8A to 8D illustrate an operation to open a door by the hinge unit shown in FIG. 7.
Figure 8B:
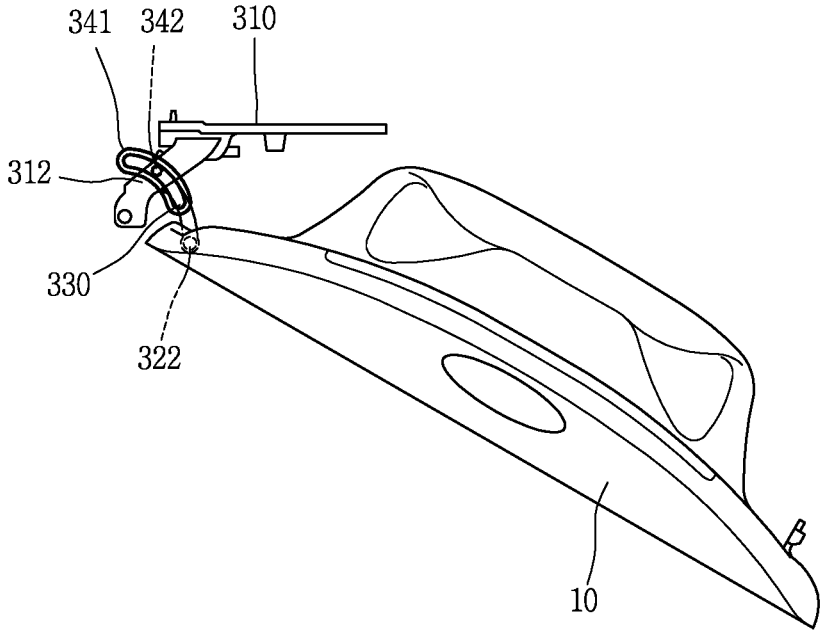
Figure 8C:
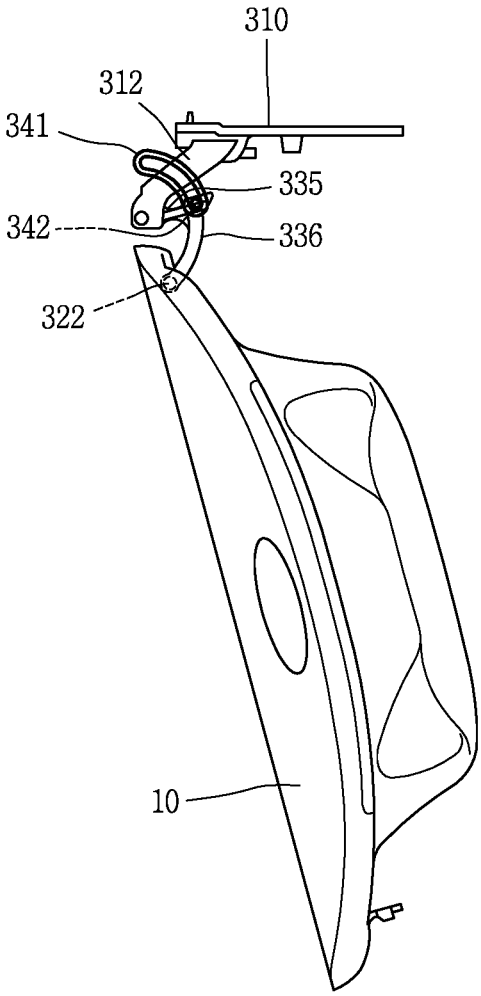
Figure 8D:
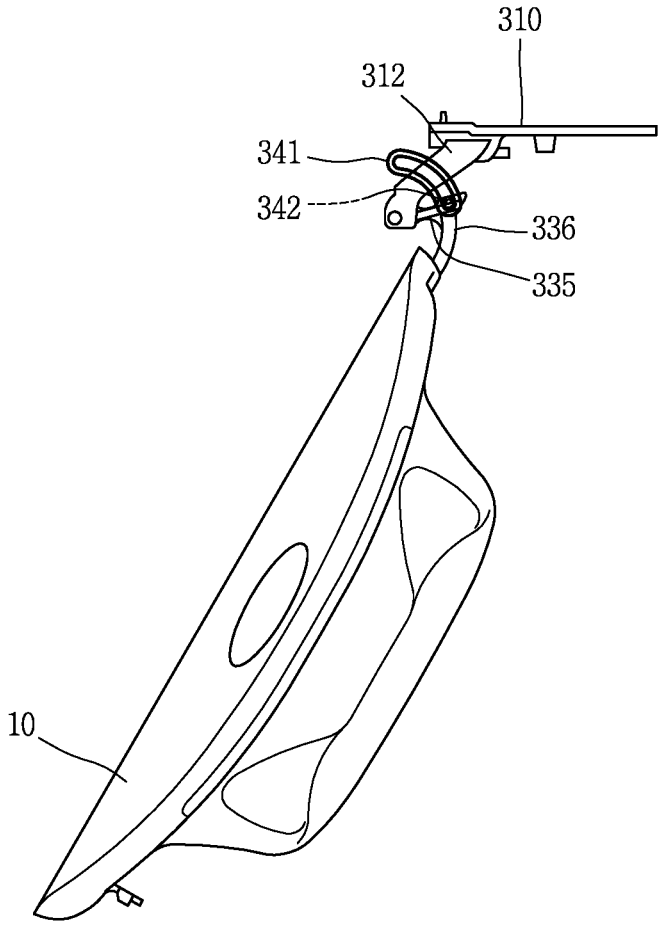

For instance, the rotation of the door 10 about the first rotation shaft 321 may be restricted in the intermediate open state. Accordingly, if an external force is applied to the door 10, the door 10 may be rotated about the second rotation shaft 322 as shown in FIG. 6D. If the rotation of the door 10 about the second rotation shaft 322 is executable up to a specific angle (in this embodiment, 45°), the door 10 may be further rotated by the specific angle in the intermediate open state. As a result, the door 10 may open the laundry introduction opening up to an open state (a state where the laundry introduction opening is not blocked when viewed from the front side).

So far, the dual hinge structure has been explained on the basis of an operation to open the door 10. An operation to close the door 10 may be performed in a reverse manner to the aforementioned method. If an external force is applied to the door 10 in an open state toward a door closing direction, the door 10 may be rotated about the second rotation shaft 322 up to the intermediate open state. If the external force is continuously applied, the connection member 330 may be rotated about the first rotation shaft 321 together with the door 10, from the intermediate open state to a closed state. As a result, the connection member 330 may be accommodated in the door accommodation unit 20*b*.

The aforementioned structure and operation may provide a laundry treating apparatus capable of opening and closing a laundry introduction opening, even in case of a concaved-type door not protruding from a body. The aforementioned hinge unit may be modified in various manners. Such modification examples will be explained in more detail with reference to the drawings.

Like the hinge unit previously described with reference to FIG. 5, the hinge unit in this embodiment may include a base member 310, a connection member 330, a first rotation shaft 321, and a second rotation shaft 322. Explanations about a structure of the components will be replaced by the aforementioned ones. The base member 310 may be provided with a mounting portion 311 and a protrusion portion 312*a*, and the connection member 330 may be provided with a first member 335 and a second member 336. The first rotation shaft 321 may form a first connection part 331, and the second rotation shaft 322 may form a second connection part 332. The protrusion portion 312*a* may be provided with a first protrusion 313 and a second protrusion 314*a*. As the door is rotated to an open state from a closed state, its rotation center may be moved to the second rotation shaft 322 from the first rotation shaft 321.

As shown, the hinge unit may further include a rotation guide unit 340. Since each of the first member 335 and the second member 336 may extend in the form of a bar, a large bending moment may occur on the first connection part 331 due to a weight of the door 10. Thus, the rotation guide unit 340 may be formed to reinforce the first connection part 331.

A guide groove 341 may be formed at the protrusion portion 312*a*, or more specifically, at the second protrusion 314*a*. For this, the second protrusion 314*a* may be formed to have a larger area than the second protrusion 314 of the base member 310 aforementioned with reference to FIG. 5. As shown, a guide protrusion 342 inserted into the guide groove 341 may be provided at a connection part between the first member 335 and the second member 336. The guide groove 341 may be formed to have a circular arc having the first rotation shaft 321 as its center. The connection member 330 may be rotated until the guide protrusion 342 is positioned at the end of the guide groove 341. Thus, the guide groove 341 may serve as a stopper, and determine a rotated degree of the connection member 330. With such a configuration, as shown in FIGS. 8A to 8D, the guide protrusion 342 may be rotated about the first rotation shaft 321, while being moved along the guide groove 341.

A laundry treating apparatus may be capable of completely opening a laundry introduction opening, even in case of a concaved-type door having its outer surface not protruding from a body. The laundry treating apparatus may also be provided with a hinge mechanism not exposed to the outside of the laundry treating apparatus, and capable of maintaining a rotation range of a door. The laundry treating apparatus may further be provided with a hinge mechanism having an operation reliability while supporting a circular door eccentric from a laundry introduction opening and having a display unit mounted thereto.

A laundry treating apparatus may include a body having a laundry introduction opening; a door configured to open the laundry introduction opening in an open state, and to close the laundry introduction opening in a closed state; and a hinge unit configured to rotatably connect the door to the body, wherein the hinge unit includes: a base member mounted to the body and a connection member having a first connection part rotatably connected to the base member, and having a second connection part to which the door is rotatably connected, such that a rotation center of the door is moved between the closed state and the open state.

In order to completely open the laundry introduction opening by a novel type of dual hinge structure, even in case of a concaved-type door, the hinge unit may include a first rotation shaft disposed on a fixed position with respect to the body and a second rotation shaft spaced from the first rotation shaft, and to which the door is rotatably connected. The first connection part and the second connection part may be configured by the first rotation shaft and the second rotation shaft, respectively. In this case, the second rotation shaft may be rotated about the first rotation shaft up to a preset angle as the door is rotated to an open state from a closed state, thereby being moved toward a direction which becomes farther from the laundry introduction opening.

The base member may be mounted to the body, so as to be biased on the basis of a horizontal center line of the door. For such a structure, the base member may include a mounting portion mounted to the body, and the mounting portion may be formed such that a width of a lower end region of the mounting portion may be narrower than a width of an upper end region of the mounting portion.

The mounting portion may be formed such that a lower area of the mounting portion may be smaller than an upper area of the mounting portion based on the horizontal center line of the door. A plurality of protrusions may protrude from the mounting portion, so as to be asymmetric to each other based on the horizontal center line of the door.

The hinge unit may be formed to accommodate at least part of an electric wire for electrically connecting the display unit to a controller provided at the body. An accommodation groove configured to accommodate the electric wire therein may be formed on at least part of the hinge unit. A cover configured to cover the accommodation groove may be mounted to the hinge unit. Connection points between the hinge unit and the door may be asymmetric to each other based on the horizontal center line of the door.

A laundry treating apparatus may include a body having a laundry introduction opening of a circular shape; a door having a display unit, having a circular shape eccentric from the laundry introduction opening, and configured to open and close the laundry introduction opening; and a hinge unit having a mounting portion mounted to the body, and configured to rotatably connect the door to the body, wherein the mounting portion is formed such that a width of a lower end region thereof is narrower than a width of an upper end region thereof.

The mounting portion may be formed such that a lower area thereof may be smaller than an upper area thereof based on the horizontal center line of the door. Further, the mounting portion may be formed such that a length from the horizontal center line of the door to an upper end of the mounting portion may be longer than a length from the horizontal center line of the door to a lower end of the mounting portion.

Any reference in this specification to "one embodiment," "an embodiment," "example embodiment," etc., means that a particular feature, structure, or characteristic described in connection with the embodiment is included in at least one embodiment. The appearances of such phrases in various places in the specification are not necessarily all referring to the same embodiment. Further, when a particular feature, structure, or characteristic is described in connection with any embodiment, it is submitted that it is within the purview of one skilled in the art to effect such feature, structure, or characteristic in connection with other ones of the embodiments.

Although embodiments have been described with reference to a number of illustrative embodiments thereof, it should be understood that numerous other modifications and embodiments can be devised by those skilled in the art that will fall within the spirit and scope of the principles of this disclosure. More particularly, various variations and modifications are possible in the component parts and/or arrangements of the subject combination arrangement within the scope of the disclosure, the drawings and the appended claims. In addition to variations and modifications in the component parts and/or arrangements, alternative uses will also be apparent to those skilled in the art.

What is claimed is:

1. A laundry treating apparatus, comprising:

a body having a laundry introduction opening of a substantially circular shape;

a door configured to open or close the laundry introduction opening and having a display and a substantially circular shape and eccentric from the laundry introduction opening; and a hinge having a mounting portion mounted to the body, and configured to rotatably connect the door to the body, wherein an upper part of the door has a greater weight than a lower part of the door based on a horizontal center line of the door, wherein a first protrusion provided above the horizontal center line of the door and a second protrusion provided below the horizontal center line of the door protrude from the mounting portion, wherein the first and second protrusions are asymmetric to each other based on the horizontal center line of the door having the substantially circular shape, and wherein a first lateral edge of the mounting portion is straight and a second lateral edge of the mounting portion is curved such that a horizontal width of the mounting portion gradually narrows from a top of the mounting portion to a bottom of the mounting portion.

2. The laundry treating apparatus of claim 1, wherein a lower area of the mounting portion is smaller than an upper area of the mounting portion based on the horizontal center line of the door.

3. The laundry treating apparatus of claim 2, wherein a width of the mounting portion is changed along a first direction.

4. The laundry treating apparatus of claim 1, wherein a length from the horizontal center line of the door to an upper end of the mounting portion is longer than a length from the horizontal center line of the door to a lower end of the mounting portion.

5. The laundry treating apparatus of claim 1, wherein a connection member to which the door is rotatably connected is mounted to the plurality of protrusions, or the door is rotatably connected to an end part of the plurality of protrusions.

6. The laundry treating apparatus of claim 1, wherein a geometric center or a weight center of the mounting portion is positioned above the horizontal center line of the door.

7. The laundry treating apparatus of claim 6, wherein the mounting portion is formed to be inclined from a vertical direction by a preset angle.

8. The laundry treating apparatus of claim 1, wherein the hinge includes:

a base member coupled to the body and comprising the mounting portion; and a connection member having a first connection part connected to the base member and a second connection part to which the door is rotatably connected.

9. The laundry treating apparatus of claim 8, wherein the first connection part is moveably coupled to the base member.

10. The laundry treating apparatus of claim 1, wherein the hinge includes at least part of an electric wire to electrically connect the display to a controller provided at the body.

11. A laundry treating apparatus, comprising:

a body having a substantially circular laundry introduction opening;

a door configured to open or close the laundry introduction opening and having a display and a substantially circular shape eccentric from the laundry introduction opening; and a hinge having a mounting portion mounted to the body and configured to rotatably connect the door to the body, wherein a length from a horizontal center line of the door to an upper end of the mounting portion is longer than a length from the horizontal center line of the door to a lower end of the mounting portion, wherein an upper part of the door has a greater weight than a lower part of the door based on the horizontal center line of the door, wherein a first protrusion provided above the horizontal center line of the door and a second protrusion provided below the horizontal center line of the door protrude from the mounting portion, wherein the first and second protrusions are asymmetric to each other based on the horizontal center line of the door having the substantially circular shape, and wherein a first lateral edge of the mounting portion is straight and a second lateral edge of the mounting portion is curved such that a horizontal width of the mounting portion gradually narrows from a top of the mounting portion to a bottom of the mounting portion.

12. The laundry treating apparatus of claim 11, wherein a lower area of the mounting portion is smaller than an upper area of the mounting portion based on the horizontal center line of the door.

13. The laundry treating apparatus of claim 12, wherein a width of the mounting portion is changed along a first direction.

* * * * *